United States Patent [19]

Labrosse

[11] Patent Number: 4,915,181

[45] Date of Patent: Apr. 10, 1990

[54] TUBING BIT OPENER

[76] Inventor: Jerome Labrosse, 1030 boul. Lajeunesse, R.R. 2, Bellefeuille, Quebec J0R 1A0, Canada

[21] Appl. No.: 261,158

[22] Filed: Oct. 24, 1988

[30] Foreign Application Priority Data

Dec. 14, 1987 [CA] Canada ..... 554249

[51] Int. Cl.[4] ..... E21B 10/34

[52] U.S. Cl. ..... 175/263; 175/265; 175/267; 175/288; 175/334

[58] Field of Search ..... 175/23, 257–259, 175/263, 265, 267, 269, 271, 284, 286, 288, 243, 317, 334, 339, 340, 363, 366, 367, 386, 391; 166/321

[56] References Cited

U.S. PATENT DOCUMENTS

| | | | |
|---|---|---|---|
| 1,468,509 | 9/1923 | Overman | 175/265 |
| 1,548,578 | 8/1925 | Blanchard | 175/288 |
| 1,659,893 | 2/1928 | Overman | 175/265 |
| 1,729,063 | 9/1929 | Bull | 175/366 |
| 1,786,484 | 12/1930 | Duda | 175/334 |
| 1,908,594 | 5/1933 | Foster | 175/288 |
| 2,047,115 | 7/1936 | Reed | 175/363 |
| 2,171,057 | 8/1939 | Crum | 175/366 |
| 4,141,421 | 2/1979 | Gardner | 175/263 |
| 4,331,207 | 5/1982 | Castel | 175/317 |

FOREIGN PATENT DOCUMENTS

| | | |
|---|---|---|
| 667133 | 7/1963 | Canada . |
| 1111833 | 11/1981 | Canada . |
| 1216277 | 1/1987 | Canada . |

OTHER PUBLICATIONS

Lockomatic Brochure: Rotary Oil Tool, Inc.

*Primary Examiner*—Bruce M. Kisliuk
*Attorney, Agent, or Firm*—Jones, Tullar & Cooper

[57] ABSTRACT

A tubing bit opener is disclosed having upper and lower cutters with the lower cutters being carried by mounting blocks having bevelled edges which are received in matching undercut grooves in the tubing bit opener. The upper cutters are attached to arms which are slidable within inclined pockets of the tubing bit opener for inward and outward movement relative to the tubing bit opener. Both the mounting blocks carrying the lower cutters and the arms carrying the upper cutters are easily removable for maintenance and repair. The lower mounting blocks are held securely in place by the drill body. Because the surfaces of the lower mounting blocks extend laterally along a considerable extent of the adjacent lowr cutters, the cutters are supported for stable rotation without vibration. The tubing bit opener is typically used to sink six inch diameter or larger caissons in any rock formation on land or under water. A predominant feature of the tubing bit opener is that the entire drilling and caisson installation procedures can be accomplished simultanenously. The advantage of simultaneous procedures is that the caisson acts as a guide to provide good alignment of the hole being drilled and it also prevents debris from falling into the hole when the drill is retracted.

Claims, 6 Drawing Sheets

TUBING BIT OPENER

BACKGROUND OF THE INVENTION

1. Field of the Invention

The present invention relates to a tubing bit opener and, in particular, to such a device adapted for the installation of caissons in earth formations.

2. Description of the Prior Art

In applicant's Canadian Patent No. 667,133, issued July 23, 1963, there is disclosed a drill employing impact cutters which in one position extend beyond the diameter of the drill body but in another position, can be retracted so that the drill can be removed through a caisson in position in the hole which has been drilled.

In applicant's Canadian Patent No. 1,216,277, issued Jan. 6, 1987 an improved device of the same type is disclosed, but which uses rotary cutters and has the advantages of easy disassembly for maintenance and repair.

The present invention relates to a further improvement to the prior devices by simplifying the construction and operation of the upper rotary cutter assembly and thereby further improving the ease of repair and maintenance.

SUMMARY OF INVENTION

The present invention provides a tubing bit opener which comprises a drill body having lower and upper rotary cutter assemblies. The lower rotary cutter assembly includes a plurality of mounting blocks each having a bevelled edge therearound that is receivable in a matching undercut groove in the drill body. These mounting blocks support rotary cutters. The upper rotary cutter assembly consists of a plurality of arms, each of which supports a rotary cutter. Each arm is slidable within a corresponding pocket in the drill body for outward and inward movement relative to the drill body. The outward movement occurs when the rotary cutter supported by the arm presses against a rock formation. Relative inward movement occurs automatically as the drill body is withdrawn, effectively reducing the diameter of the drill body and permitting it to be retracted upwardly through tubing inserted into the drill hole as drilling progresses.

BRIEF DESCRIPTION OF THE DRAWINGS

Preferred embodiments of the invention will now be described with reference to the accompanying drawings, in which.

DESCRIPTION OF THE PREFERRED EMBODIMENTS

Figure 1:
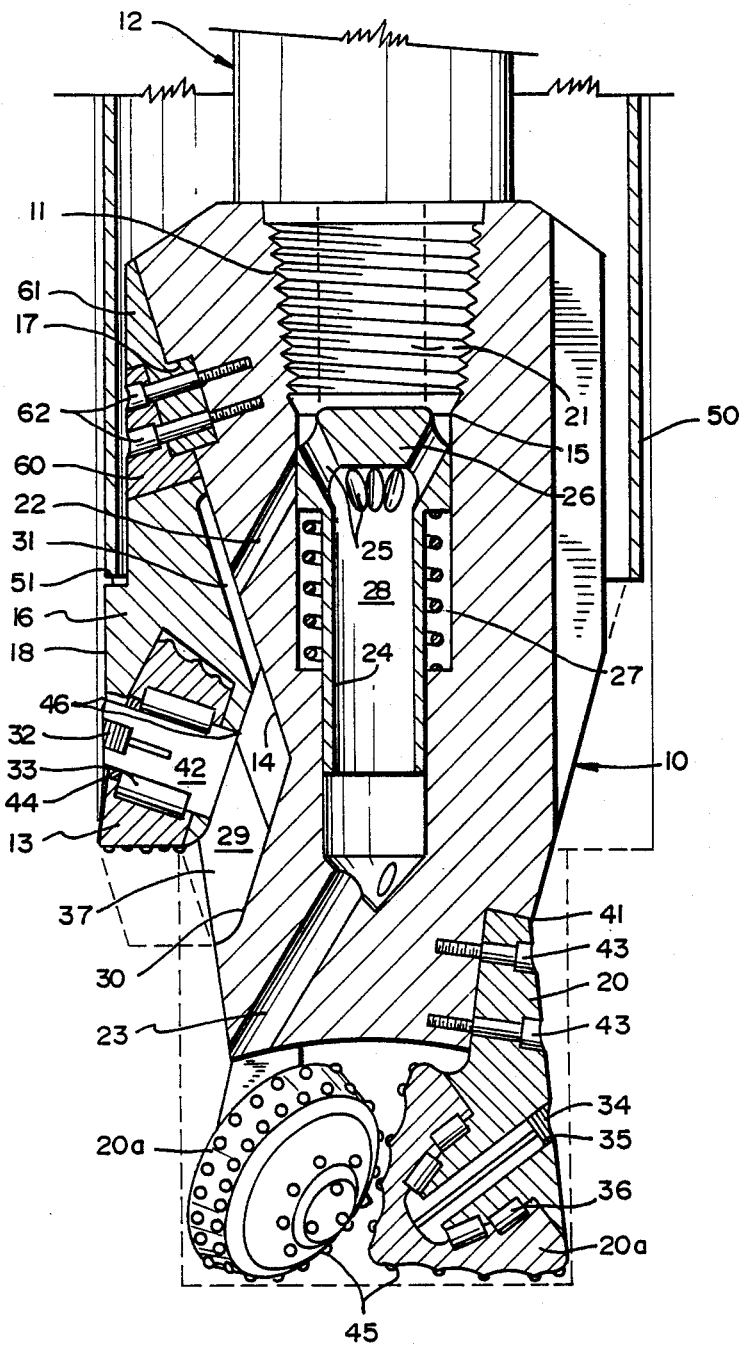
FIG. 1 is a cross-section of the tubing bit opener showing its operation in positioning a caisson in an earth formation.

FIG. 1 shows a generally cylindrical drill body, indicated at 10, having a threaded connection 11 in its upper portion arranged to receive a conventional drill rod connector 12. Drill body 10 is provided with two sets of rolling cutters. The upper cutters 13 are carried by arms 16 which are slidable within corresponding inclined pockets 37 so that they can be extended outwardly of the body. The lower cutters 20*a*, which are readily replaceable, are securely fastened at the lower end of the drill body at a position to remove material to form a hole of the appropriate diameter to receive the drill body.

A central passage 28 in the drill body communicates with the drill pipe through passage 21 in connector 12 to receive the stream of air or water used as drilling fluid. This central passage leads to side passages 22 communicating with the upper set of cutters 13 and lower passages 23 communicating with lower cutters 20*a* so that debris released by the cutters may be swept away. Longitudinal grooves are formed along drill body 10 at positions not occupied by the cutters to provide a passage for return to the surface of material dislodged.

A movable piston 24 is located in the central passage 28 and is used to aid in controlling the expandable movement of the arms 16 carrying the cutters 13. Piston 24 has passages 25 formed in it to permit the drilling fluid to pass downwardly through the central passage in the drill body when the piston is displaced downwardly. When the pressure of drilling fluid in the drill pipe increases it acts on head 26 of piston 24 to force it downwardly against the force of spring 27. On reduction of drilling fluid pressure piston 24 moves upwardly under the force of spring 27 until head 26 is seated against edge 15 of the wall of passage 21 (see FIG. 1).

Details of the structure of the cutters may be seen in FIG. 1. The lower cutter mounting block 20 is formed with a bevelled edge (not shown) extending therearound. This edge is received in a matching undercut groove 41 formed in the lower portion of the drill body. The mounting block is held rigidly in position by bolts 43 but, as can be seen, can be readily dismounted from the drill body for replacement of the cutter. The cutting elements are formed by carbide tips 45 but could instead be formed by toothed steel, if desired. Upper cutters 13 are each provided with a grease passage 32 communicating with roller support bearings 33. Similarly, lower cutters 20*a* have a grease passage 34 communicating with roller support bearings 36. The upper roller support bearings are kept in place by O-ring 44 and bearing support axle 42. By welding or soldering the ends of the axle containing the grease supply tube to the cutter mounting block, as shown at 35 a particularly rigid structure is obtained. The axle containing grease tube 32 of the upper cutter can similarly be welded or soldered as shown at 46 to the arm 16 to provide a rigid axis about which the cutter head rotates.

Figure 2:
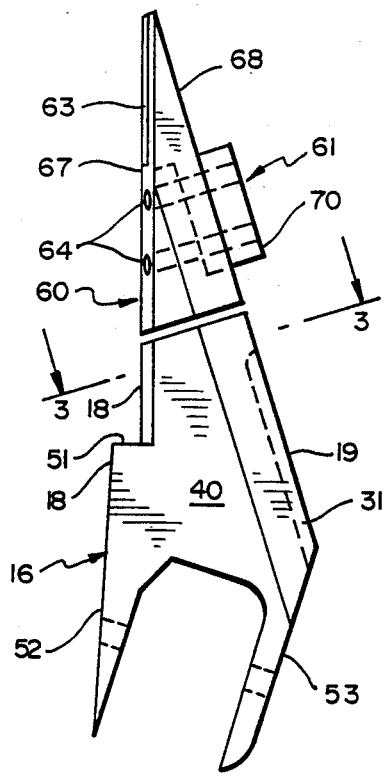
FIG. 2 is a side view of an arm of the upper rotary cutter assembly and the upper stop means.
Figure 3:
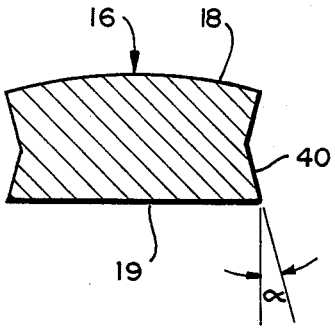
FIG. 3 is a cross section of the upper arm taken at line 3—3 on FIG. 2.
Figure 4:
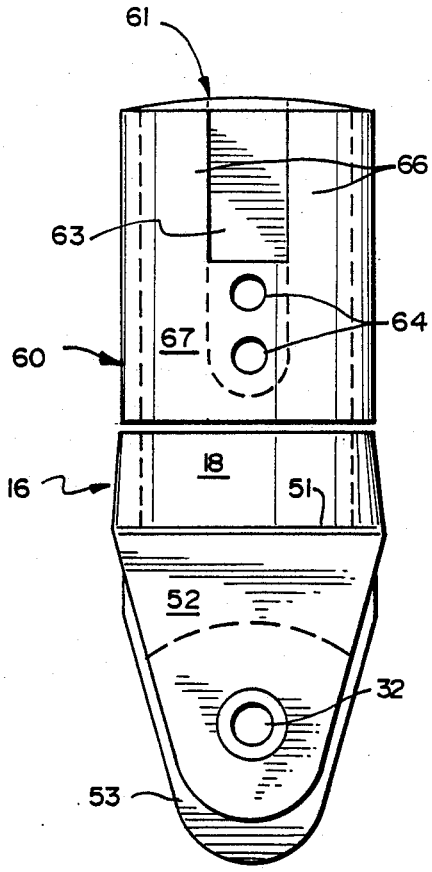
FIG. 4 is a view of the outer surface of the arm and the upper stop means.
Figure 5:
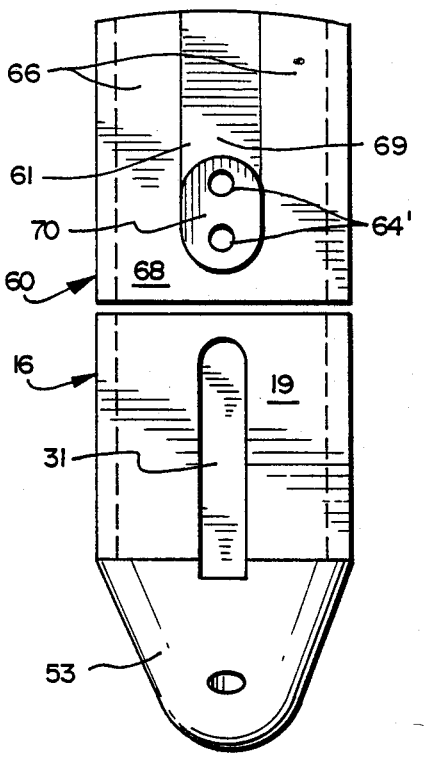
FIG. 5 is a view of the inner surface of the arm and the upper stop means taken at right angles to the inner surface.
Figure 6:
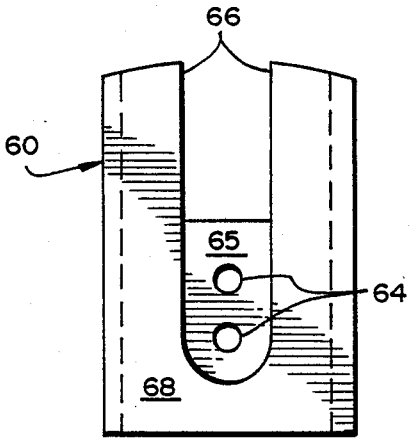
FIG. 6 is a rear view of the outer slidable member of the upper stop means.

Additional details of the upper rotary cutter assembly are shown in FIGS. 1 to 7. Arms 16 carry upper cutters 13. The arm has a curved outer surface which matches the curvature of the drill body 10. The outer surface 18 has an outwardly extended shoulder 51 below which the cutter 13 is welded into place. The inner surface 19 of the arm 16 is at an angle inclined to the outer surface. An elongated recessed channel 31 is centrally located within the inner surface 19 and opens to the lower edge thereof. The lower portion of arm 16 consists of two lug members 52, 53 between which the cutter 13 is located. The inner lug member 53 is inclined in the opposite direction to the inner surface 19 of the arm 16. The side surfaces 40 of the arm 16 are inwardly grooved as shown in FIG. 3. These grooves are preferably v-shaped having an angle of indentation $\alpha$. In the preferred embodiment of the present invention, $\alpha$ is equal to about 15°.

Arm 16 is slidable along a matching inclined surface 14 of drill body 10 (see FIG. 1). Matching outwardly v-shaped surfaces 29 in drill body 10 permit arm 16 to slide within the inclined pocket 37 parallel to inclined surface 14. The recessed channel 31 is located on the inner surface 19 in such a way that drilling fluid passing through side passage 22 will flow into and along the channel 31 down to the cutter 13.

The sliding movement of arm 16 is limited by upper and lower stop means. In the preferred embodiment, the lower stop means is an inclined surface 30 of the drill body which mates with the inclined rear surface of the inner lug 53.

The upper stop means consists of outer and inner members, 60 and 61 which are bolted to the drill body 10 by bolts 62. Several views of the upper stop members are shown in FIGS. 2 to 7. Outer member 60 is U-shaped (FIG. 6) having a rectangular gap between vertical legs 66. It has a flat base, a curved outer surface 67 and an inclined inner surface 68 so that the side of the member is triangular in shape (see FIG. 2). Outer member 60 has grooved side surfaces similar to side surfaces 40 of arm 16. It is thereby slidable within the inclined pocket 37 of the drill body 10 when not bolted into place by bolts 62.

The inner surface 68 of member 60 has a recessed area 65 having bores 64 through which bolts 62 pass. Recessed area 65 also receives inner member 61.

Figure 7:
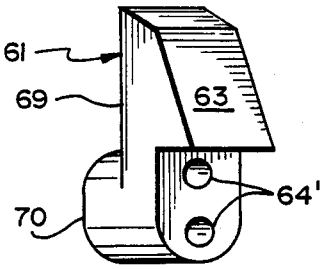
FIG. 7 is a perspective view of the inner member of the upper stop means.

FIG. 7 is a perspective view of inner member 61. As can be seen in FIGS. 1 and 2, inner member 61 is positioned between drill body 10 and outer member 60 so that surface 63 is vertical and is located in the same curvilinear plane as the outer surface 67 of outer member 60 and the drill body 10. The lower portion of inner member 61 has bores 64' which are aligned with bores 64 of the outer member 60. The surface 63 extends between legs 66 of the outer member 60. The upper portion of the inner surface 69 of member 61 aligns with the inclined inner surfaces 68 an 19 of outer member 60 and arm 16. The lower portion 70 of inner member 61 extends inwardly toward drill body 10 (see FIG. 2) for reception in a mating recess 17 in the drill body 10.

An advantage of the present invention is the ease of assembly and disassembly of the upper rotary cutter apparatus. In order to assemble the upper rotary cutter apparatus, arm 16 having cutter 13 welded thereon is slid within the inclined pocket 37 parallel to inclined surface 14 of the drill body 10 until its inner lug 53 abuts against inclined surface 30. Arm 16 is guided and supported by its grooved sides 40 and the mating v-shaped surfaces 29 of drill body 10. Outer stop member 60 is then slid within inclined pocket 37 until its base abuts against the upper surface of arm 10. Outer member 60 is also guided by its grooved sides and the v-shaped surfaces 29 of drill body 10. Inner member 61 is then put into place so that its inwardly extending portion 70 is inserted into the matching recess 17 of the drill body 10. Outer member 60 is then slid upwards so that the outer part of the lower portion of inner member 61 is received in recessed area 65 and surface 63 is located between legs 66. Finally, bolts 62 are passed through bores 64 and 64' and secured into drill body 10.

Figure 8:
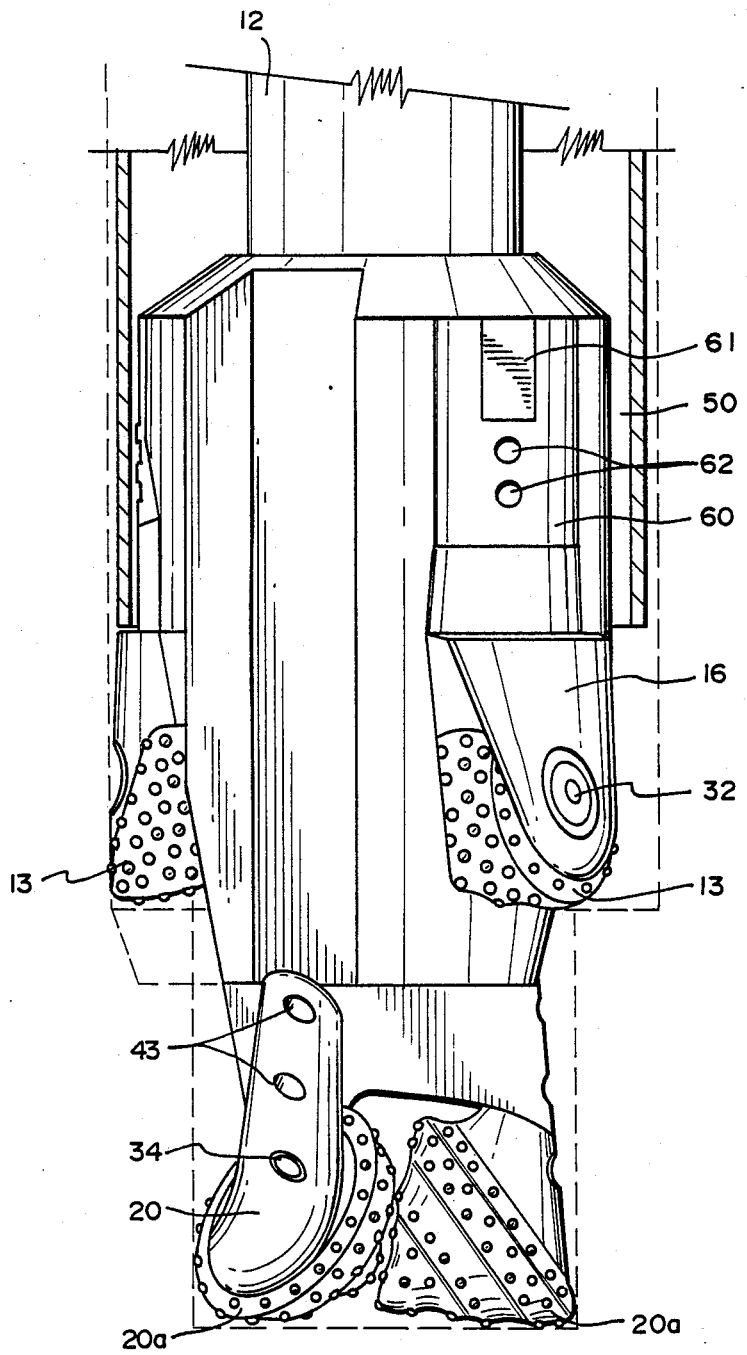
FIG. 8 is a perspective view of the drill bit opener as a whole with the upper rotary cutter assembly at its outward position.

A typical use of the tubing bit opener of this invention is to sink a caisson as shown at 50 in FIGS. 1 and 8. As the lower cutters cut into the ground, the tubing bit opener 10 begins to move downwardly with the upper cutter assembly being initially in its lowest and retracted position, abutting against inner surface 30 of the drill body 10. As the tubing bit opener moves further down, upper cutter 13 presses against the surrounding ground which causes arm 16 to slide upwardly and outwardly, relative to the drill body, until abutting against the upper stop means, members 60 and 61. The hole being drilled is thereby increased in diameter due to the cutters 13. Fluid pressure caused by drilling fluid flowing through passage 21, piston 24, side passages 22 and along recessed channel 31 also aids in the extension of the upper rotary cutter assembly by applying a relatively upwards force against the uppermost edge surface of channel 31.

Caisson 50 follows closely behind shoulder 51 of arm 16. This provides two advantages: the first is that the caisson acts as a guide to provide good alignment of the hole being drilled; the second is that the caisson prevents debris from falling into the hole. When the tubing bit opener is to be withdrawn, the flow of drilling fluid is ceased. As the drill is withdrawn, shoulder 51 is pushed against caisson 50 causing arm 16 to slide relatively downward into its retracted position. The drill can then be removed through the caisson, leaving it in its final position.

Figure 9:
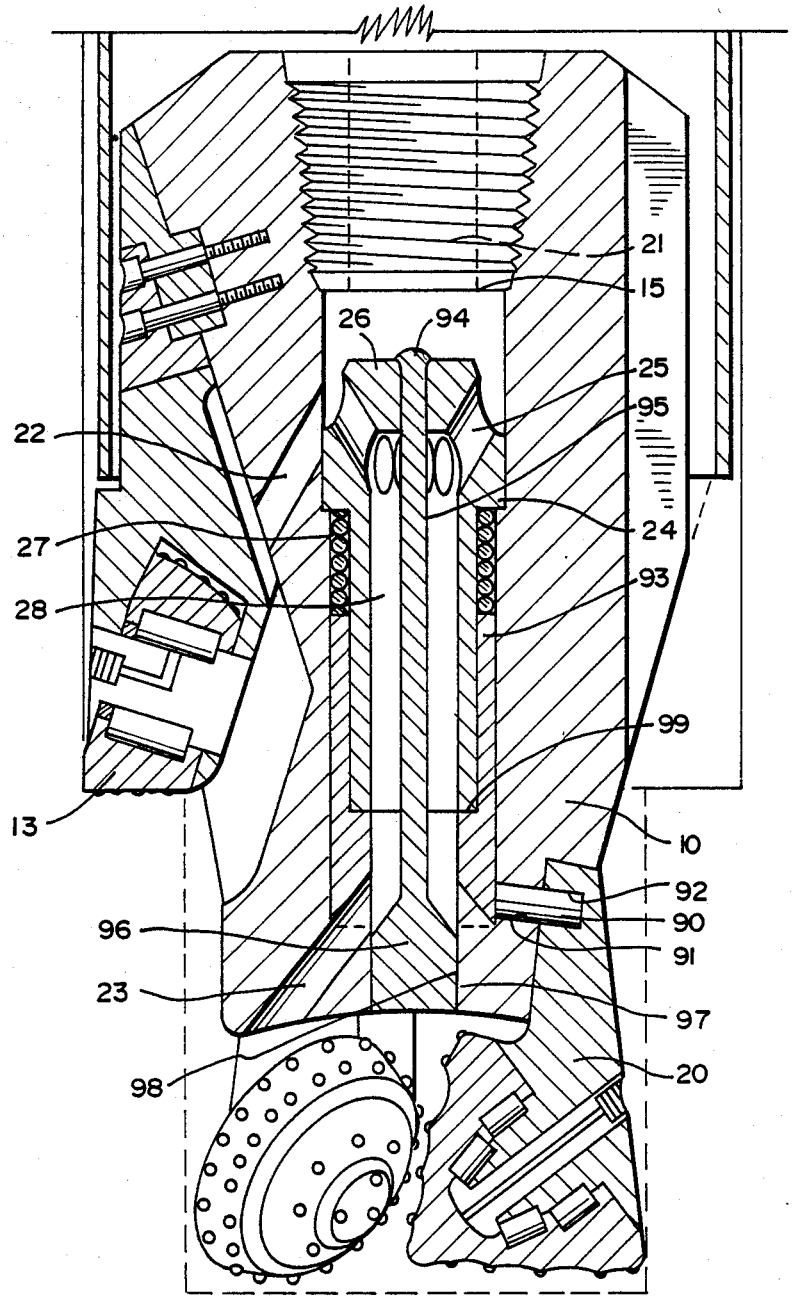
FIG. 9 is a cross-section of an additional embodiment of the tubing bit opener with the fluid passages in an open position.
Figure 10:
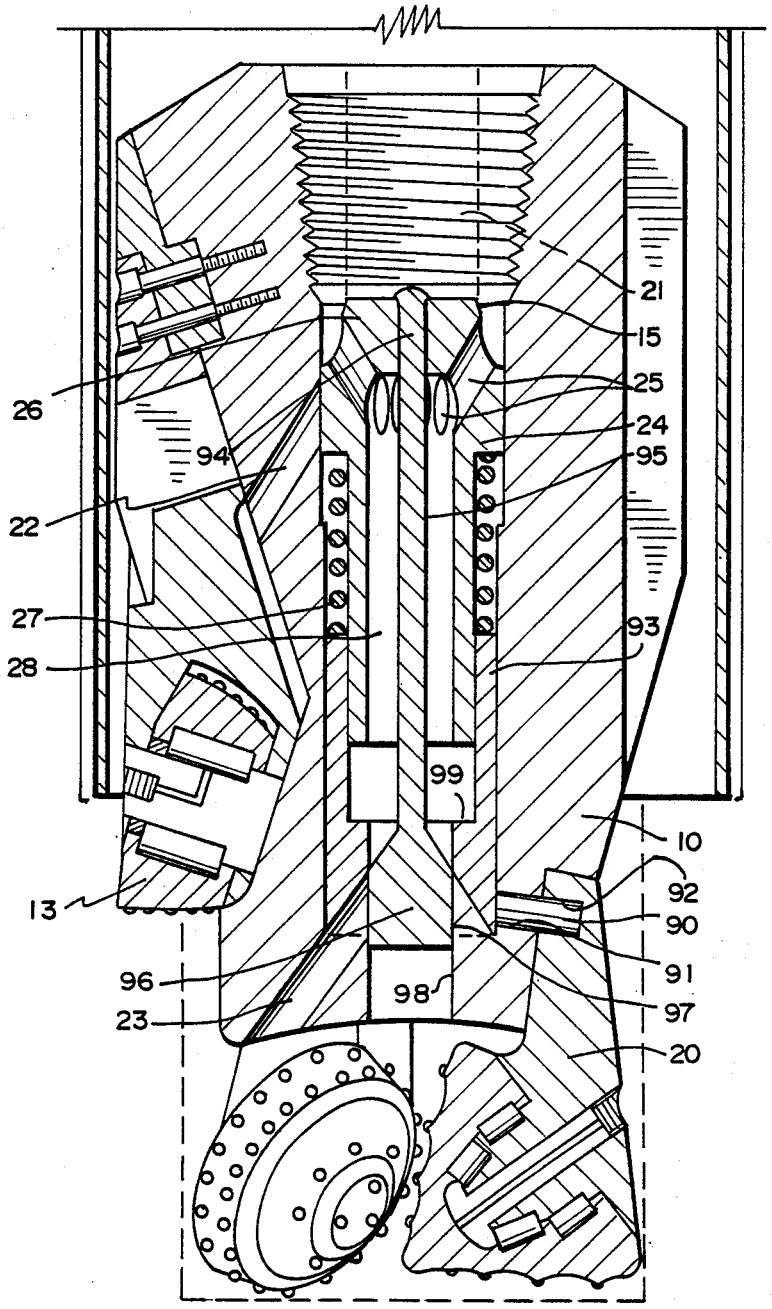
FIG. 10 is a view similar to that of FIG. 9 showing a cross-section of the additional embodiment with the fluid passages in a closed position.

FIGS. 9 and 10 illustrate an embodiment of the tubing bit opener which has an improved fluid passage system. These figures also show an alternative means of mounting the lower cutter mounting blocks 20 to the drill body 10.

Referring to FIGS. 9 and 10, each lower cutter mounting block 20 is mounted by means of an internal pin 90 which passes through a bore 91 formed in the drill body 10 and is inserted into a recess 92 in the mounting block 20. Internal pin 90 is held in place by means of an internal sleeve 93 which is fitted into the central passage 28 below spring 27. Sleeve 93 has an upper surface which acts as a support against which spring 27 can be compressed. The inner diameter of the upper portion of the internal sleeve 93 receives piston 24 slidably therein. The lower portion of sleeve 93 extends inwardly to form a stop surface 99 for piston 24 when in its lower position.

Piston 24 includes a rod member 95 which is fitted through a bore 94 in the head 26 of the piston and extends downwardly therethrough and into the central passage 28. Rod member 95 has an expanded lower end portion 96 having side surfaces 97. Side surfaces 97 are in slidable contact with the inner surface 98 of the central passage 28.

The advantage of this arrangement is that it prevents the drilling fluid and entrained debris from backing up into the central passage 28 of the tubing bit opener when pressure has been reduced.

With reference to FIG. 9, the tubing bit opener is shown in an operating position with the piston 24 depressed. Spring 27 is compressed against the upper surface of inner sleeve 93 and the base of piston 24 rests upon the stop surface 99 of the sleeve 93. In this position, drilling fluid passes through passage 21 into the upper part of the central passage 28. The fluid then passes through side passages 22 to operate the upper set of cutters 13 and through passages 25 in piston 24 and into the central passage 28 of the drill body 10. The drilling fluid then flows from the central passage 28 through lower passages 23 so that debris resulting from this operation of the lower cutters may be swept away through the longitudinal grooves which are formed along the drill body and up to the surface.

When the fluid pressure is reduced, the piston moves upwardly to its closed position as seen in FIG. 10, blocking the passage 26 by edge 15 and blocking side passages 22. The upward movement of rod member 95 results in side surfaces 97 obstructing by lower passages 23 and thereby preventing drilling fluid with entrained debris from flowing into the drill body and possibly damaging the piston system.

The drill body, the expandable and replaceable cutter arms, and the replaceable lower cutter units are formed from precision cut steel. Since the cutter arms and the lower cutter units are interchangeable among themselves, fewer spares need be kept. Typical dimensions are a drill body of 6 inch diameter with the expandable cutters extensible by 9/16 inch. The caisson used can have a wall thickness of 3/16 inch and an inner diameter of 6 3/16 inch. When following the tubing bit opener downwardly the end of the caisson is spaced by about ½ inch from shoulder 51. If the formation proves to be unconsolidated, then cement can be pumped down the drill rod to flow outside the caisson and to the formation. The tubing bit opener can be gradually withdrawn during this process. After the cement has hardened drilling can be resumed through the now stabilized formation.

While specific components of the present apparatus are defined above, various modifications may be made by those skilled in the art without departing from the scope of the invention as limited by the appended claims.

I claim:

1. A tubing bit opening comprising:

a drill body having lower and upper rotary cutter assemblies;

said lower rotary cutter assembly including a plurality of mounting blocks, each receivable in said drill body and supporting an independently rotatable cutter thereon, said lower cutter assembly being readily dismountable from said drill body;

said upper rotary cutter assembly comprising a plurality of arms, each arm supporting an independently rotatable cutter and being slidable between upper and lower stop means within a corresponding inclined pocket in said drill body for outward movement relative to said drill body when said independently rotatable cutter supported thereby is pressing against an earth foundation; and wherein said upper stop means comprises an inner member supported in a recessed portion of said drill body, and an outer, v-shaped member having a base, a rectangular gap between vertical legs, a curved outer surface, inwardly v-shaped side surfaces and an inclined surface having a recessed area through which a plurality of bores pass, said outer member being slidable within said corresponding inclined pocket, and said inner and outer members being secured in a removable manner to said drill body.

2. The tubing bit opener as in claim 1 wherein said inner member includes an upper portion having an outwardly extending curved outer surface, an inclined inner surface, and an inwardly extending lower portion through which a plurality of bores pass.

3. A tubing bit opener as in claim 2 wherein said recessed area of said slidable outer member receives said inner member such that said outwardly extending outer surface of said inner member extends between the vertical legs of said outer member, wherein said plurality of bores passing through said outer and inner members are aligned, and wherein said inwardly extending lower portion of said inner member is supported in a recessed portion of said drill body.

4. A tubing bit opener comprising:

a drill body having lower and upper rotary cutter assemblies;

said lower rotary cutter assembly including a plurality of mounting blocks receivable in said drill body and supporting an independently rotatable cutter thereon, said lower rotary cutter assembly being readily dismountable from said drill body;

said upper rotary cutter assembly including a plurality of arms, each arm having an outer surface, each arm supporting an independently rotatable cutter, and each arm being slidable between an upper stop means and a lower inclined surface within a corresponding inclined pocket in said drill body for outward movement relative to said drill body when the rotatable cutter supported thereby is pressing against an earth formation, said lower inclined surfaces providing a lower stop means against which a mating inclined surface on the corresponding arm abuts when the arm is in its relatively lowermost position;

means for providing fluid under pressure from a central cavity of said drill body to the plurality of arms of said upper rotary cutter assembly;

a plurality of conduits each having an entrance at said central cavity and an exit at one of said inclined pockets; and a recessed area on one surface of each of said plurality of arms and located opposite an exit of a corresponding conduit.

5. A tubing bit opener as in claim 4 wherein each of said plurality of arms has an inwardly v-shaped groove extending along each side edge thereof and wherein each inclined pocket in said drill body has outwardly v-shaped surfaces extending therealong such that said inwardly v-shaped surfaces of said arms are in slidable mating relation to corresponding outwardly v-shaped surfaces of said drill body.

6. A tubing bit opener as in claim 5 wherein each of said plurality of arms has a shoulder formed on said outer surface thereof above the upper rotary cutter assembly.

7. A tubing bit opener as in claim 5 wherein said plurality of mounting blocks of said lower rotary cutter assembly are removably mounted to the drill body by means of an internal pin and an internal sleeve located in said central cavity.

8. A tubing bit opener as in claim 4 wherein each of said plurality of arms has a shoulder formed on said outer surface.

9. A tubing bit opener as in claim 4 wherein said plurality of mounting blocks of said lower rotary cutter assembly are removably mounted to the drill body by means of an internal pin and an internal sleeve located in said central cavity.

10. A tubing bit opener as in claim 4 wherein said upper stop means includes an inner member supported in a recessed portion of said drill body, and an outer member slidable within said corresponding inclined pocket, said outer member having a base for limiting movement of said arm, said inner and outer members being secured in a removable manner to said drill body; and wherein said lower stop means comprises a lower surface within each pocket against which a mating inclined surface on the corresponding arm abuts when the arm is in its relatively lowermost position.

11. A tubing bit opener comprising:

a drill body having lower and upper rotary cutter assemblies;

said lower rotary cutter assembly including a plurality of mounting blocks receivable in said drill body and supporting an independently rotatable cutter thereon, said lower rotary cutter assembly being readily dismountable from said drill body;

said upper rotary cutter assembly including a plurality of arms, each having an outer surface adjacent said drill body, each arm supporting an independently rotatable cutter and being slidable between an upper stop means and a lower inclined surface within a corresponding inclined pocket in said drill body for outward movement relative to said drill body when the rotatable cutter supported thereby is pressed against an earth formation, said lower inclined surface providing a lower stop means against which a mating inclined surface on the corresponding arm abuts when the arm is in its relatively lowermost position;

means for providing fluid under pressure from a central cavity of said drill body to the rotary cutters of said lower rotary cutter assembly; and a movable, spring biased piston located in said central cavity for controlling the pressure of said fluid under pressure, said movable piston having a plurality of fluid passages formed therein.

12. A tubing bit opener as in claim 11 wherein said movable piston further includes a central rod member fitted into a head of said piston and extending downwardly through said central cavity, said rod member having an expanded lower end portion with side surfaces in slidable contact with inner walls of said central cavity, said piston being movable between a raised position wherein said side surfaces of siad expanded end portion prevent fluid flow through said means for providing fluid pressure to the lower rotary cutters, and a lower position which permits flow to said rotary cutters.

13. A tubing bit opener as in claim 12, wherein each of said plurality of arms has a shoulder formed on said curved outer surface thereof above the upper rotary cutter assembly.

14. A tubing bit opener as in claim 12 wherein said plurality of mounting blocks of said lower rotary cutter assembly are movably mounted to the drill body by means of an internal pin and an internal sleeve located in said central cavity.

15. A tubing bit opener as in claim 11, wherein each of said plurality of arms has a shoulder formed on said outer surface thereof above the upper rotary cutter assembly.

16. A tubing bit opener as in claim 11 wherein said plurality of mounting blocks of said lower rotary cutter assembly are removably mounted to the drill body by means of an internal pin and an internal sleeve located in said central cavity.

17. A tubing bit opener as in claim 11 wherein said upper stop means includes an inner member supported in a recessed portion of said drill body, and an outer member slidable within said corresponding inclined pocket, said outer member having a base for limiting movement of said arm, said inner and outer members being secured in a removable manner to said drill body; and said lower stop means includes a lower surface within each pocket against which a mating inclined surface on the corresponding arm abuts when the arm is in its relatively lowermost position.

* * * * *